US009321078B2

(12) United States Patent
Kolbe et al.

(10) Patent No.: US 9,321,078 B2
(45) Date of Patent: Apr. 26, 2016

(54) STRUCTURED SURFACE CONTACTING PRINTING MATERIAL AND PRINTING MATERIAL PROCESSING MACHINE

(71) Applicant: HEIDELBERGER DRUCKMASCHINEN AG, Heidelberg (DE)

(72) Inventors: Wolfram Kolbe, Heidelberg (DE); Angela Kuhrt, Sandersdorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/821,963

(22) Filed: Aug. 10, 2015

(65) Prior Publication Data

US 2015/0343491 A1 Dec. 3, 2015

Related U.S. Application Data

(62) Division of application No. 13/047,164, filed on Mar. 14, 2011, now Pat. No. 9,132,625.

(30) Foreign Application Priority Data

Mar. 12, 2010 (DE) ..... 10 2010 011 249

(51) Int. Cl.

| | |
|---|---|
| ***B41F 3/34*** | (2006.01) |
| ***B05D 5/02*** | (2006.01) |
| ***B05D 5/08*** | (2006.01) |

(52) U.S. Cl.

CPC .. *B05D 5/02* (2013.01); *B05D 5/08* (2013.01); *Y10T 428/24372* (2015.01)

(58) Field of Classification Search

None

See application file for complete search history.

(56) References Cited

U.S. PATENT DOCUMENTS

| | | | |
|---|---|---|---|
| 5,120,693 | A | 6/1992 | Connolly et al. |
| 6,291,070 | B1 | 9/2001 | Arpac et al. |
| 6,723,387 | B1 | 4/2004 | Kear et al. |
| 7,287,750 | B2 | 10/2007 | Boguhn et al. |
| 7,641,194 | B2 | 1/2010 | Draxler et al. |
| 7,651,560 | B2 | 1/2010 | Risse et al. |
| 2004/0247899 | A1 | 12/2004 | Bier et al. |

(Continued)

FOREIGN PATENT DOCUMENTS

| | | | |
|---|---|---|---|
| CN | 1798797 | A | 7/2006 |
| DE | 19957325 | A1 | 5/2001 |

(Continued)

*Primary Examiner* — Joshua D Zimmerman

(74) *Attorney, Agent, or Firm* — Laurence A. Greenberg; Werner H. Stemer; Ralph E. Locher

(57) ABSTRACT

A method for producing a structured surface making contact with printing material, preferably a cylinder cover, includes producing a structured coating having microparticles on a substrate, preferably a stainless steel plate. The microparticles are encased antiadhesively and agglomerated by adsorption of nanoparticles, and the agglomerates being produced are fixed in a sol-gel matrix. A surface produced in this way has a structured coating on a substrate and the coating has microparticles. The coating has agglomerates fixed in a sol-gel matrix and including microparticles encased antiadhesively by adsorption of nanoparticles and preferably formed of silicon carbide. The surfaces advantageously have a self-repair function since, in the case of abrasion of structural elevations, the antiadhesive casings of the microparticles are exposed and the antiadhesive property of the coating is maintained.

7 Claims, 2 Drawing Sheets

(56) References Cited

U.S. PATENT DOCUMENTS

| | | | |
|---|---|---|---|
| 2009/0169865 | A1 | 7/2009 | Risse et al. |
| 2009/0298369 | A1 | 12/2009 | Koene et al. |

FOREIGN PATENT DOCUMENTS

| | | | |
|---|---|---|---|
| DE | 10227758 | A1 | 1/2004 |
| DE | 102005060734 | A1 | 6/2006 |
| DE | 102008048848 | A1 | 2/2009 |
| JP | 11-165399 | A | 6/1999 |

STRUCTURED SURFACE CONTACTING PRINTING MATERIAL AND PRINTING MATERIAL PROCESSING MACHINE

CROSS-REFERENCE TO RELATED APPLICATION

This application is a divisional of copending patent application Ser. No. 13/047,164, filed Mar. 14, 2011; the application also claims the priority, under 35 U.S.C. §119, of German patent application No. DE 10 2010 011 249.6, filed Mar. 12, 2010; the prior applications are herewith incorporated by reference in their entirety.

BACKGROUND OF THE INVENTION

Field of the Invention

The present invention relates to a method for producing a structured surface which makes contact with printing material, in which a structured coating which has microparticles is produced on a substrate. The invention also relates to a method for the self-repair of a structured surface which makes contact with printing material, in which a structured coating is disposed on a substrate. Furthermore, the present invention relates to a structured surface which makes contact with printing material, having a structured coating on a substrate, in which the coating has microparticles. The invention further relates to a machine which processes printing material, for example a printing press, in particular a sheet-processing rotary printing press for lithographic offset printing or, for example, a machine for further print processing. The invention additionally relates to a use of agglomerates for the self-repair of structured surfaces which make contact with printing material.

In machines of the so-called graphics industry (prepress stage, print production and further print processing), printing materials, for example paper, cardboard or film, are conveyed and processed. The printing materials can be conveyed in printing presses by using rotating cylinders which, for that purpose, have surfaces which make contact with printing material, preferably in the form of changeable cylinder covers ("jackets"). The surfaces are, as a rule, equipped with two properties: firstly they are antiadhesive (they repel ink, varnish and dirt) and secondly they are wear resistant due to the usually very hard materials which are used. Furthermore, the surfaces as a rule have a usually microscopic structure, that is to say they are not configured to be smooth, but rather (micro-) rough. That roughness reduces a contact area for the printing material and therefore the possibility of ink being deposited on the surface. For example, thermally sprayed (and therefore microrough), ceramic coatings with sealings having a low surface energy, such as silicone, have been used for some years (such as the "PerfectJacket" product from Heidelberger Druckmaschinen AG).

German Published Patent Application DE 10 2005 060 734 A1, corresponding to U.S. Pat. No. 7,651,560, discloses an antiadhesive layer including crosslinked nanoparticles, for example polyorganosiloxanes, for cylinder covers. They are crosslinked three-dimensionally and applied by using the sol-gel process. In addition, hard particles (diameter from 0.1 to 0.5 micrometer), for example diamond powder or boron nitride, can be added. The layer which is formed therefrom has uniformly distributed particles. It is not disclosed whether the layer which is produced in that way has its own structure or is applied to a separate structural layer.

Japanese Published Patent Application JP 11-165399 A has disclosed a transport roll for printing materials with a structural coating. A two step coating process for producing a roll of that type includes firstly spraying on ceramic particles with a diameter of from 5 to 60 micrometers and secondly spraying on silicone (and subsequent drying as a third step). A rough surface structure is formed, there being more particles in structural elevations than in structural troughs.

The surfaces which are disclosed in the prior art can at the same time have two disadvantages: firstly, as a result of the unavoidable wear, the covers can lose their roughness, if it exists, and secondly they can lose their antiadhesivity which is necessary for the self-cleaning effect.

One further concept which has not been pursued, however, by the invention could be seen in removing the worn covers from the machine and subjecting them to a repair process, for example by recoating. However, a process of that type would presumably be very time-consuming and expensive.

A similar repair process which is carried out in a machine is described, for example, in German Published Patent Application DE 102 27 758 A1. In that case, however, only nanoparticles (using the sol-gel process) are used and not microparticles. It is not disclosed whether the layer which is repaired in that way has its own structure or is applied to a separate structural layer.

Furthermore, German Published Patent Application DE 199 57 325 A1 has disclosed a coating composition for producing abrasion resistant anticorrosion layers for metals, with an antiadhesive sol-gel matrix being produced. A disadvantage of the described layer is the possible loss of the antiadhesive action during mechanical loading, such as abrasion.

SUMMARY OF THE INVENTION

It is accordingly an object of the invention to provide a method for producing a structured surface contacting printing material, a structured surface, a machine and a method for self-repair of structured surfaces, which overcome the hereinafore-mentioned disadvantages of the heretofore-known methods, products and devices of this general type. In particular, it is an object of the present invention to provide a method which makes the production of antiadhesive and wear resistant and/or self-repairing surfaces possible, or makes their self-repair possible. Moreover, it is a further or alternative object of the present invention to provide a surface which makes contact with printing material and has antiadhesive and wear resistant and/or self-repairing properties which are maintained even in the case of mechanical loading, such as abrasion. In addition, it is an object of the present invention to provide a cost-reducing method of using agglomerated particles.

With the foregoing and other objects in view there is provided, in accordance with the invention, a method for producing a structured surface for contacting printing material. The method comprises producing a structured coating having microparticles on a substrate, antiadhesively encasing and agglomerating the microparticles by adsorption of nanoparticles to produce agglomerates, and fixing the agglomerates in a sol-gel matrix.

The invention advantageously makes it possible to produce antiadhesive and wear resistant and/or self-repairing properties with few steps and, in particular, with only one coating step.

In accordance with another mode of the method of the invention, the microparticles have a size of from approximately 1 to approximately 5 micrometers and agglomerates with a size of from approximately 10 to approximately 50 micrometers are produced from them.

In accordance with a further mode of the method of the invention, structural elevations of the coating are formed substantially by the agglomerates.

With the objects of the invention in view, there is also provided a method for the self-repair of a structured surface for contacting printing material. The method comprises producing a structured coating on a substrate, providing the coating with structural elevations containing microparticles having antiadhesive casings formed by adsorption of nanoparticles, and exposing the microparticles together with their respective antiadhesive casings by abrasion of peaks of the structural elevations.

The invention advantageously makes it possible to produce self-repairing properties and, based on this, a self-repair function.

With the objects of the invention in view, there is furthermore provided a structured surface for contacting printing material. The structured surface comprises a substrate, and a structured coating disposed on the substrate, the structured coating having agglomerates fixed in a sol-gel matrix and microparticles encased antiadhesively by adsorption of nanoparticles.

The invention advantageously makes it possible to produce a surface with antiadhesive and wear resistant and/or self-repairing properties.

In accordance with another feature of the surface of the invention, the microparticles have a size of from approximately 1 to approximately 5 micrometers and the agglomerates have a size of from approximately 10 to approximately 50 micrometers.

In accordance with a further feature of the surface of the invention, structural elevations of the coating are formed substantially by the agglomerates.

In accordance with an added feature of the surface of the invention, the microparticles have silicon carbide.

With the objects of the invention in view, there is additionally provided a use of agglomerates which are fixed in a sol-gel matrix and include microparticles which are encased antiadhesively by adsorption of nanoparticles, for the self-repair of structured surfaces which make contact with printing material.

With the objects of the invention in view, there is concomitantly provided a printing material processing machine, for example a printing press, in particular a sheet-fed rotary printing press for lithographic offset printing or, for example, a machine for further print processing, comprising at least one structured surface according to the invention for making contact with printing material.

The invention which is described and the advantageous developments of the invention which are described also represent, in combination with one another, advantageous developments of the invention. A coating according to the invention, for example, is particularly preferred with agglomerated and encased microparticles of a size of from approximately 1 to approximately 5 micrometers and agglomerates of a size of from approximately 10 to approximately 50 micrometers, with structural elevations of the coating being formed substantially by the agglomerates.

Other features which are considered as characteristic for the invention are set forth in the appended claims.

Although the invention is illustrated and described herein as embodied in a method for producing a structured surface contacting printing material, a structured surface, a machine and a method for self-repair of structured surfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
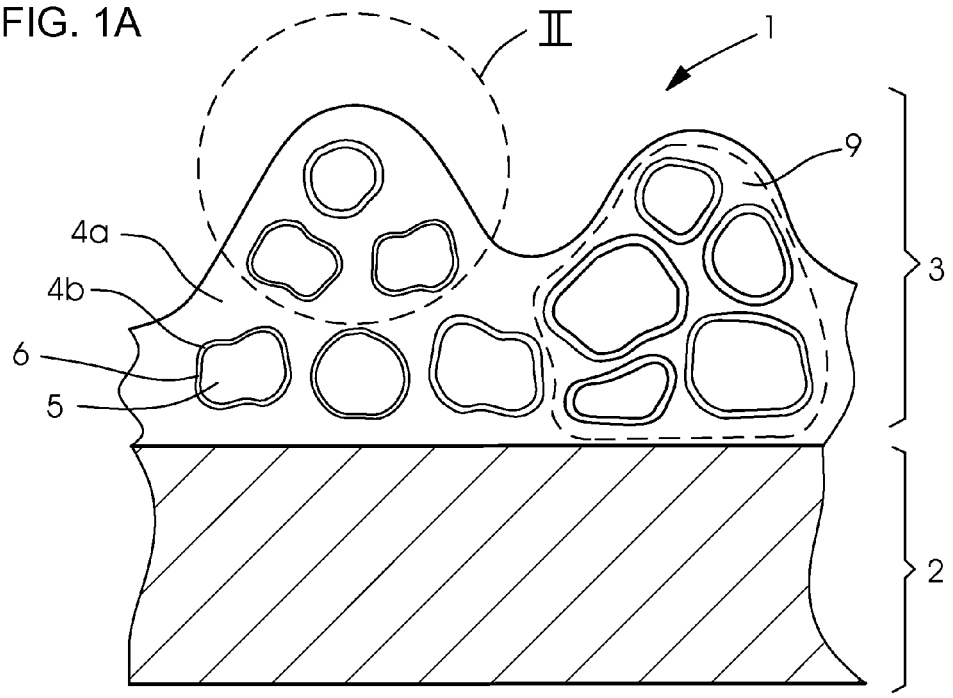
FIG. 1A is a diagrammatic, sectional view of a preferred exemplary embodiment of a cylinder cover according to the invention.

Referring now to the figures of the drawings in detail and first, particularly, to FIG. 1A thereof, there is seen a diagrammatic, sectional view of a preferred exemplary embodiment of a cylinder cover 1 according to the invention. The cover has a substrate 2, preferably made from stainless steel and, as an alternative, from aluminum, titanium, steel or plastic, and a wear resistant and antiadhesive coating 3. The coating 3 includes a sol-gel matrix 4*a* including crosslinked nanoparticles with microparticles 5 which are incorporated into the matrix 4*a*.

The sol-gel matrix per se can be produced or built up in a conventional manner, preferably in accordance with the matrix which is disclosed in German Published Patent Application DE 199 57 325 A1. A product "H 5055" from the company FEW Chemicals GmbH in Bitterfeld-Wolfen, Germany is preferably used for the nanosol. However, during the production according to the invention, in a deviation from the known method, the above-mentioned microparticles 5 or corresponding starting material for the microparticles 5 are additionally dispersed. In a deviation from the known layer, the layer which is produced according to the invention has the above-mentioned microparticles incorporated into the matrix.

The microparticles 5 which are incorporated into the matrix 4*a* and are fixed by the matrix are preferably made from silicon carbide (SiC) or, as an alternative, from silicon, aluminum oxide ($Al_2O_3$), glass or ceramic. The silicon carbide which is preferably used can be purchased as a powder, for example, from the producer H. C. Starck in Goslar, Germany under the identifier "Type 25."

In addition, it can be seen in FIG. 1 A that the microparticle s 5 are provided in each case with an antiadhesive casing 6 including nanoparticles 4*b* which are adsorbed on the microparticle surface. The respective antiadhesive casings 6 have a thickness of from approximately 0.5 to approximately 5 micrometers. The microparticles 5 therefore have their own sol-gel casings and are therefore antiadhesively coated themselves. According to the invention, this results in the advantage shown in the enlarged portion II in FIG. 2, which is that as the wear increases, although the microparticles 5 can be exposed by abrasion of peaks 7 of structural elevations 8, they maintain the antiadhesivity of the layer 3 and the cover 1 over an extended time period due to their own antiadhesivity.

Figure 1B:
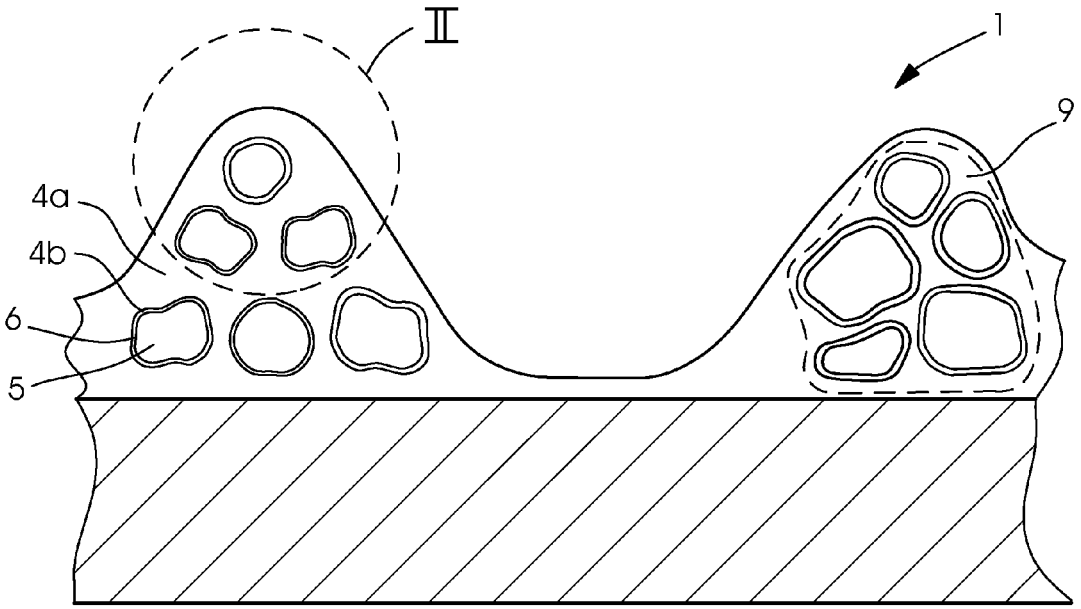
FIG. 1B is a further diagrammatic, sectional view of a preferred exemplary embodiment of a cylinder cover according to the invention.
Figure 2:
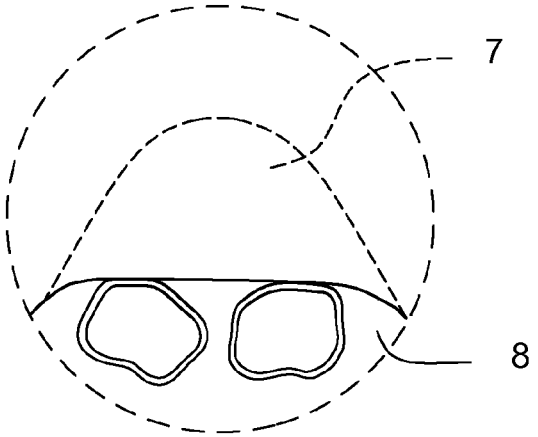
FIG. 2 is an enlarged, fragmentary view of a portion II of FIGS. 1A and 1B.

FIG. 1B shows a further diagrammatic sectional view of a preferred exemplary embodiment of a cylinder cover 1 according to the invention. In this case, the matrix 4*a* between agglomerates 9 is substantially free of microparticles 5, with the result that structural troughs are formed substantially only by the matrix 4*a*. Although non-agglomerated microparticles 5 can also be present in places, they do not make a substantial contribution to the structure. The structure of the cover 1 is therefore formed substantially from the structural peaks including the agglomerates 9 and the structural troughs including the matrix 4*a*.

Figure 3:
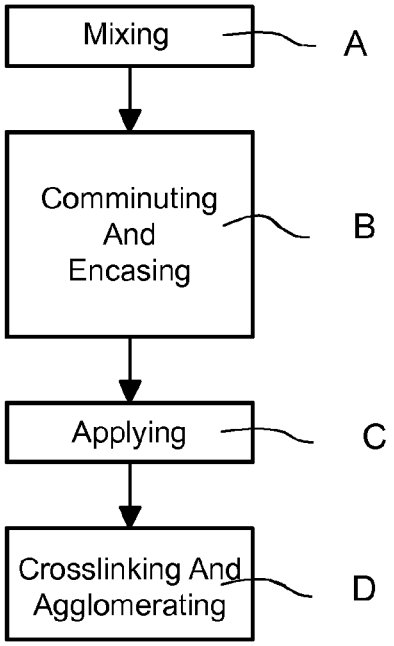
FIG. 3 is a flow chart of a preferred exemplary embodiment of a method according to the invention.

FIG. 3 shows a flow chart of a preferred exemplary embodiment of a method according to the invention. In a first step A (mixing), a starting material for the above-mentioned microparticles 5 is added to the nanosol (preferably in accordance with German Published Patent Application DE 199 57 325 A1). The starting material includes so-called primary particles in powder form, that is to say particles which are agglomerated only to a small extent or loosely, with a size of from 1 to approximately 50 micrometers, preferably with a size of from 10 to approximately 30 micrometers. In one successful experiment, approximately 200 grams of primary particles were added to approximately 3 liters of sol.

In a second method step B (comminuting and encasing), the sol is stirred together with the primary particles and a dispersion is produced. In the successful experiment, dispersing was carried out for approximately 30 minutes at from approximately 10,000 to approximately 20,000 revolutions per minute.

Due to the stirring and, in particular, if a stirring device is used which acts mechanically on the primary particles, for example a stirring-machine mill, the primary particles are comminuted to a size of from approximately 1 to approximately 5 micrometers, preferably to a size of from approximately 2 to approximately 3 micrometers and particularly preferably to a size of approximately 2.5 micrometers. The microparticles 5 are produced from the primary particles in this way. At the same time, nanoparticles 4*b* of the sol adsorb at the surface of the microparticles 5 and form the above-mentioned casings 6 of the microparticles 5.

A dispersion 4 which is produced in this way is applied to the substrate 2 in a third method step C (applying), preferably by spraying onto the substrate 2 (successfully, for example, by way of a so-called High Volume Low Pressure (HVLP)-Spray pistol from the company SATA GmbH & Co. KG in Kornwestheim, Germany). A first agglomeration of the microparticles 5 already occurs during the spraying-on process.

In a following fourth step D (crosslinking and agglomerating), the applied layer 3 is treated thermally, that is to say crosslinked and cured. In one successful experiment, the crosslinking was carried out at approximately 150° C. In this case, the solvent of the dispersion evaporates and a further agglomeration of the microparticles 5 and the formation of the structure of the surface occur, with structural elevations being formed predominantly by the agglomerates 9 (see FIGS. 1A and 1B). In this way, layers 3 can be produced with Rz values of from approximately 10 to approximately 50 micrometers, preferably with Rz values of from 20 to approximately 40 micrometers.

One advantage of the invention is to be seen in the fact that a structured and antiadhesive surface can be produced with only one coating step (method step C). It is therefore not required according to the invention, for example, to first of all apply a structural layer and then separately an antiadhesive layer. The production process according to the invention can be carried out less expensively due to that second coating step being omitted.

A further advantage results from the effect of the agglomerated and in each case encased microparticles 5. The structural elevations 8 and the agglomerates 9 are extremely wear resistant, since even an abrasion of the structural peaks 7 does not lead to a complete loss of the necessary antiadhesivity. In other words: the structure has a self-repair function which is based on the structurally internal, antiadhesive casings of the structural particles 5.

As an alternative to the above-described comminution of the primary particles, sufficiently small primary particles can also be admixed and encased without substantial comminution in method step B. However, the use of primary particles to be comminuted as described above is preferred, since they can be obtained less expensively and the comminution process assists the encasing according to the invention with nanoparticles.

The cylinder covers according to the invention can preferably be used on transfer cylinders, turner cylinders and impression cylinders, both in small formats (so-called 5 format and smaller) and also in large formats (so-called 6, 7 and 8 formats, or all formats which are larger than 890×1,260 millimeters).

The following is a preferred example for the combination according to the invention of classic sol-gel chemistry with the abrasion/wear resistance of mineral microparticles as filler in layer compositions according to method step A:

a) from 5 to 40% of one or a mixture of a plurality of metal or semimetal alkoxides of the general formula M(O—R1)n (M=B, Al, Si, Ti ; R1=alkyl, aryl, acyl, alkoxyalkyl), b) from 30 to 70% of one or a mixture of a plurality of functionalized or nonfunctionalized organosilanes of the general formula R2×Si(R3)4-x (R2=alkyl C1-C20, alkenyl C1-C20, aryl, 3-aminopropyl, 3-glycidoxypropyl, 3-methacryloxypropyl, aminoethyl aminopropyl, 3-mercaptopropyl; R3=alkoxy, aryloxy, Cl) and mixtures of hydrolysis and condensation products of different organosilanes of this type, the organic radicals of which can react with one another, c) from 0 to 10% of one or more fluorinated polyethers, the polymer chain of which is constructed from tetrafluoroethylene oxide or heptafluoroethylene oxide chains and which has at least one hydrolyzable silyl radical which is bonded through a pure carbon chain or from 0 to 10% of one or more organosilanes with a fluorine-containing side chain, and d) from 20 to 70% of a pulverulent, scratch resistant pigment (primary particles), for example with a Mohs hardness of >7.

All solvents which can be mixed with water and the starting compounds being used can be used as solvent. In the case of components (a) and (b), they are normally ketones and alcohols, such as acetone, butanone, ethanol, n-propanol, isopropanol, n-butanol, pentanol, 1-methoxy-2-propanol and mixtures thereof. Lower alcohols, such as methanol and ethanol, have proven particularly advantageous due to the compatibility, in particular, with components (d).

For the hydrolysis of the alkoxides and the organosilanes, water is added in an at least semistoichiometric amount in relation to hydrolyzable groups, but is preferably added in a stoichiometric or superstoichiometric amount, in order to ensure complete hydrolysis. All customary bases and acids which are soluble in the system can be used as catalysts for the hydrolysis and condensation. Acid catalysis is preferred.

Tetraalkoxysilanes and, in particular, tetraethyl orthosilicate (TEOS) are preferably used as metal or semimetal alkoxides. Alkylsilanes and arylsilanes without further functional groups are particularly suitable as organosilanes, but organosilanes with functional groups can also be used, such as epoxy, amino and perfluorine groups. Mineral pigments with a Mohs hardness of ≥7 are suitable as scratch resistant particles, such as quartz (hardness 7), corundum (hardness 9), silicon carbide (hardness 9.5) and diamond (hardness 10).

The invention claimed is:

1. A structured surface contacting printing material, the structured surface comprising:

a substrate; and a structured coating disposed on said substrate, said structured coating having agglomerates fixed in a sol-gel matrix and microparticles encased antiadhesively by adsorption of nanoparticles.

2. The surface according to claim 1, wherein said microparticles have a size of from approximately 1 to approximately 5 micrometers, and said agglomerates have a size of from approximately 10 to approximately 50 micrometers.

3. The surface according to claim 1, wherein said structured coating has structural elevations formed substantially by said agglomerates.

4. The surface according to claim 1, wherein said microparticles include silicon carbide.

5. A printing material processing machine, comprising:

a structured surface according to claim 1 for making contact with printing material.

6. The machine according to claim 5, wherein the machine is a printing press.

7. The machine according to claim 5, wherein the machine is a sheet-fed rotary printing press for lithographic offset printing or a machine for further print processing.

* * * * *